US009120494B2

(12) United States Patent
Kumar et al.

(10) Patent No.: US 9,120,494 B2
(45) Date of Patent: Sep. 1, 2015

(54) SYSTEM, METHOD AND COMPUTER SOFTWARE CODE FOR REMOTELY ASSISTED OPERATION OF A RAILWAY VEHICLE SYSTEM

(75) Inventors: Ajith K. Kumar, Erie, PA (US); John E. Hershey, Ballston Lake, NY (US); Carlos L. Hanze, Erie, PA (US); Wolfgang Daum, Erie, PA (US); David M. Davenport, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 1604 days.

(21) Appl. No.: 11/566,384

(22) Filed: Dec. 4, 2006

(65) Prior Publication Data

US 2008/0128563 A1 Jun. 5, 2008

(51) Int. Cl.
*B61L 3/12* (2006.01)

(52) U.S. Cl.
CPC ..... *B61L 3/127* (2013.01)

(58) Field of Classification Search
USPC ..... 246/3, 4, 5, 166.1, 167 R, 187 C, 187 R, 246/187 B, 187 A; 701/19, 20; 340/903
See application file for complete search history.

(56) References Cited

U.S. PATENT DOCUMENTS

| | | | | |
|---|---|---|---|---|
| 3,312,508 | A * | 4/1967 | Keller et al. | 303/19 |
| 5,685,507 | A * | 11/1997 | Horst et al. | 246/187 A |
| 6,218,961 | B1 * | 4/2001 | Gross et al. | 340/903 |
| 6,834,219 | B2 * | 12/2004 | Proulx | 246/187 A |
| 6,837,466 | B2 * | 1/2005 | Peltz | 246/187 A |
| 6,863,247 | B2 * | 3/2005 | Horst | 246/187 A |
| 7,770,847 | B1 * | 8/2010 | Severson | 246/3 |
| 2004/0238695 | A1 | 12/2004 | Horst | |
| 2004/0245410 | A1 * | 12/2004 | Kisak et al. | 246/3 |
| 2005/0125113 | A1 * | 6/2005 | Wheeler et al. | 701/19 |
| 2005/0205720 | A1 * | 9/2005 | Peltz et al. | 246/187 A |

FOREIGN PATENT DOCUMENTS

| | | |
|---|---|---|
| DE | 19743306 | 4/1999 |
| EP | 1344703 | 9/2003 |
| WO | WO2006/093536 | 9/2006 |

* cited by examiner

*Primary Examiner* — Mark Le
(74) *Attorney, Agent, or Firm* — GE Global Patent Operation; John A. Kramer

(57) ABSTRACT

A method for operating a train having at least one locomotive vehicle, the method including controlling operation of the train via a first crew member located on-board the locomotive unit, providing information that may be required for operation of the train to a second crew member located remote from the first crew member, and using the information to enable the second crew member to assist the first crew member in the controlling of the train.

13 Claims, 3 Drawing Sheets

SYSTEM, METHOD AND COMPUTER SOFTWARE CODE FOR REMOTELY ASSISTED OPERATION OF A RAILWAY VEHICLE SYSTEM

FIELD OF INVENTION

The field of invention relates to railway vehicle system operations and, more specifically, to railway vehicle operations wherein railway vehicle operations is remotely assisted by a "virtual" crew member.

BACKGROUND OF THE INVENTION

Typically two persons, an engineer and conductor, are required to operate railway vehicle systems such as locomotive trains. For example, the engineer (or train driver) of a locomotive freight train usually commands the movement of the train based on experience and input from on-board and off-board control and signaling devices. The conductor manages operation of the train, and oversees the actions taken by the engineer. Both crew members work together to properly control the train in accordance with railway rules and procedures.

More specifically, the engineer is responsible for operation of the locomotive in which he or she is physically present, and also for operation of other locomotives of the railroad train. The engineer controls all mechanical operation of the train and all train handling operations, including controlling the speed and braking of the train. Toward this end, the engineer is also responsible for preparing cars and equipment for service, checking paperwork and vital seals, controlling acceleration, braking and handling of the moving train, under the direction of the conductor. Usually, the engineer is familiar with the route the train travels, and thus has learned and memorized physical characteristics of the railroad, including grades, crossings, yards, sidings, signal locations, conditions around passenger stations and all speed limits. Along with the conductor, the engineer monitors time to not fall behind schedule, nor leave yards, sidings, stations, etc. early. This often requires running at reduced speed when following other trains, approaching route diversions, or regulating time over road to avoid arriving too early, when built-in "recovery time" in schedule is not needed. The engineer also is expected to assume duties of conductor if incapacitated or removed.

The conductor manages operation of the train, and is in charge of all other crew members on board the train. Conductors are usually responsible for mechanical inspection of the rolling stock, assisting the engineer in testing the air brake on the train, signaling the engineer when to start moving or in switching operations, to stop as well, reading the signal lights, keeping a record or log of the journey, checking tickets along with assistant conductors on passenger trains, attending to the needs of passengers (on passenger trains), keeping records of consignment notes and waybills (on freight trains), and sometimes assisting with shunting or switching of track devices.

Motivated mainly by several factors, such as, but not limited to, availability of trained conductors/operators, schedule constraints, emergency operations, the requirement for utilizing two person crews has come under question. Some carriers have questioned the need for the conductor's position since the engineer by qualification, can assume the duties of a conductor and perform the tasks of the other crew member wherein reduced skills may be required. Others, however, maintain that two persons are necessary to meet a high standard of safety and experience required and expected of a consist operator in the presence and potential of exigencies that might otherwise imperil life, equipment, and goods being transported on a train.

In another application, locomotives are available with double cabs at both ends of the locomotive where size constraints may only allow for a single individual in either end. Such locomotive configurations are typically used in regions of the world other than the United States. It may be useful to have one operator in the front cab and another operator providing information to the operator in the front cab, located in the back cab or another locomotive in the locomotive consist.

Toward this end, train owners and operators would benefit if options existed with respects to crew size wherein a high standard of safety and experience remains available to assist in operating the railway vehicle system regardless of crew size and/or on-board crew member's skill level.

BRIEF DESCRIPTION OF THE INVENTION

Exemplary embodiments of the invention are directed towards railway vehicle operations where a reduced number of operators are aboard the railway vehicle and assistance is available from a virtual crew member. Toward this end, in an exemplary embodiment, a method for operating a train having at least one locomotive vehicle is disclosed. The method includes controlling operation of the train via a first crew member located on-board the locomotive unit. Information is provided that may be required for operation of the train to a second crew member located remote from the first crew member. The information is used to enable the second crew member to assist the first crew member in the controlling of the train.

In another exemplary embodiment, in a train having at least one locomotive, a method for operating the train with assistance from a virtual second crew member located at a remote location is disclosed. The method includes determining real-time information pertinent to operation of the train. The real-time information is communicated to a second virtual crew member located at a remote location. The real-time information is reviewed by the virtual second crew member. Communications between the train and the virtual second crew member information to assist in operating the train occurs.

In another exemplary embodiment, in a train having at least one locomotive, a system for operating the train with assistance from a virtual second crew member located at a remote location is disclosed. The system has a remote location housing the virtual second crew member. A plurality of sensors to monitor real-time information proximate the train is also included. A communication network is also provided that allows for communication of sensor data from the train to the remote monitoring facility and communication of train operation parameters from the virtual second crew member located at the remote location to the train.

In yet another exemplary embodiment, a system for operating a train with assistance from a virtual second crew member located at a remote location is disclosed. The system includes a vital data module that collects vital data from the train, and a communication network allowing communication between the train and the remote location. An interface module is also provided for the virtual second crew member at the remote location to interface over the communication network with at least one of the train and a crew member aboard the train. Furthermore a control interface module is included that interfaces over the communication network control linkages between the second crew member and at least one of the train and a crew member aboard the train.

In another exemplary embodiment, computer software code for providing information from a remote location for operating a train having a locomotive and/or a computer is disclosed. The computer software code includes a computer software module for controlling operation of the train via a first crew member located on-board the locomotive unit. A computer software module for providing information that may be required for operation of the train to a second crew member located off-board the train is also disclosed. Also provided for is a computer software module for using the information to enable the second crew member to assist the first crew member in the controlling of the train.

In another exemplary embodiment, in a train having at least one locomotive and a first computer aboard the train, a computer software code for operating the train with assistance from a virtual second crew member located at a remote location with a second computer is disclosed. The computer software code includes a computer software module for determining real-time information pertinent to operation of the train. A computer software module for communicating the real-time information to a second virtual second crew member located at a remote location is also provided. Also included is a computer software module for reviewing the real-time information by the virtual second crew member. A computer software module is also provided for communicating between the train and the virtual second crew member information to assist in operating the train.

BRIEF DESCRIPTION OF THE DRAWINGS

A more particular description of exemplary embodiments of the invention briefly described above will be rendered by reference to specific embodiments thereof that are illustrated in the appended drawings. Understanding that these drawings depict only typical embodiments of the invention and are not therefore to be considered to be limiting of its scope, the exemplary embodiments of the invention will be described and explained with additional specificity and detail through the use of the accompanying drawings in which.

DETAILED DESCRIPTION OF THE INVENTION

Figure 1:
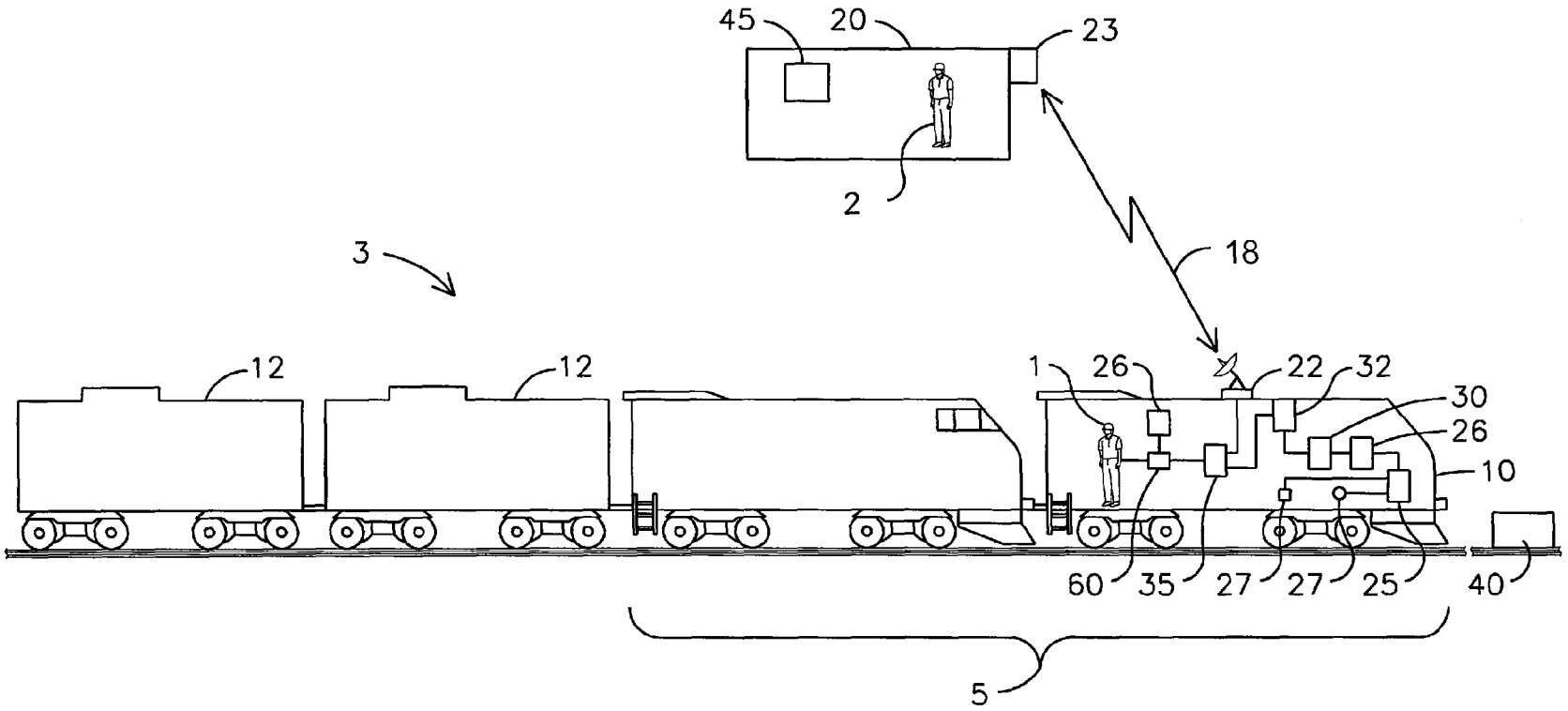
FIG. 1 depicts an exemplary embodiment of elements of a system for remotely assisting operation of a railway vehicle system.

Exemplary embodiments of the present invention solves the problems in the art by providing a system, method, and computer software code, for allowing a reduced number of crew members, and/or crew members with reduced skills, to operate the rail vehicle, such as but not limited to a train with a virtual second crew member located at a remote location. Persons skilled in the art will recognize that an apparatus, such as a data processing system, including a CPU, memory, I/O, program storage, a connecting bus, and other appropriate components, could be programmed or otherwise designed to facilitate the practice of the method of an exemplary embodiment of the invention. Such a system would include appropriate program means for executing the method.

Broadly speaking, the technical effect is operating a train where a single operator is aboard the train and a second operator is virtually available. The invention may be described in the general context of computer-executable instructions, such as program modules, being executed by a computer. Generally, program modules may include routines, programs, objects, components, data structures, etc., that perform particular tasks or implement particular abstract data types. For example, the software programs that underlie the invention can be coded in different languages, for use with different computing platforms. Examples of the invention may be implemented in the context of a web portal that employs a web browser. It will be appreciated, however, that the principles that underlie the invention can be implemented with other types of computer software technologies as well.

Moreover, those skilled in the art will appreciate that the invention may be practiced with other computer system configurations, including hand-held devices, multiprocessor systems, microprocessor-based or programmable consumer electronics, minicomputers, mainframe computers, and the like. The invention may also be practiced in distributed computing environments where tasks are performed by remote processing devices that are linked through a communications network. In a distributed computing environment, program modules may be located in both local and remote computer storage media including memory storage devices.

Also, an article of manufacture, such as a pre-recorded disk or other similar computer program product, for use with a data processing system, could include a storage medium and program means recorded thereon for directing the data processing system to facilitate the practice of the method of the invention. Such apparatus and articles of manufacture also fall within the spirit and scope of the invention. Throughout this document the term locomotive consist is used. As used herein, a locomotive consist may be described as having one or more locomotives in succession, connected together so as to provide motoring and/or braking capability. The locomotives are connected together where no train cars are in between the locomotives. The train can have more than one consist in its composition. Specifically, there can be a lead consist, and more than one remote consists, such as midway in the line of cars and another remote consist at the end of the train. Each locomotive consist may have a first locomotive and trail locomotive(s). Though a consist is usually viewed as successive locomotives, those skilled in the art will readily recognize that a consist group of locomotives may also be recognized as a consist even when at least a car separates the locomotives, such as when the consist is configured for distributed power operation, wherein throttle and braking commands are relayed from the lead locomotive to the remote trails by a radio link or physical cable. Toward this end, the term locomotive consist should be not be considered a limiting factor when discussing multiple locomotives within the same train.

Referring now to the drawings, embodiments of the present invention will be described. The invention can be implemented in numerous ways, including as a system (including a computer processing system), a method (including a computer implemented method), an apparatus, a computer readable medium, a computer program product, a graphical user interface, including a web portal, or a data structure tangibly fixed in a computer readable memory. Several embodiments of the invention are discussed below.

FIG. 1 depicts an exemplary embodiment of elements of a system for remotely assisting operation of a railway vehicle system. An exemplary railway vehicle, such as but not limited to a train 3, has at least one power unit, or locomotive 10, and may have a string of cars 12. The number of locomotives 10 and the number of cars 12 may vary based on a specific train mission. The locomotive 10 may have a single crew member 1 on board, which may be the only crew member physically on-board the train. A communication path 18, or link, is provided between the train 3 and a remote location 20, such as a remote monitoring center. At least one individual located at the remote location 20 will function as virtual second crew member 2 to a specific train 3. The communication path 18 provides two-way real-time communications and may traverse a network that includes land-based wired portions and wireless portions. For example, the portion of the communication path 18 that immediately terminates and/or originates at the train 3, is wireless.

Transceivers 23, 22 respectively, located at the remote location 20 and the train 3, are used for communicating between the locomotive consist 5 and remote location 20. Those skilled in the art will readily recognize that the transceiver 22 on the train 3 may be at any location on the train 3, and not necessarily the locomotive consist 5, or locomotive 10. When not on the locomotive 10, a train on-board communication system may be used to relay communications vital to operations between the locomotive 10 and the transceiver 22. One or both transceivers 22, 23 may have communications prophylactic and assurance protocols for performing such functions as encryption and authentication.

A first module 25 located on the locomotive consist 5 is a vital data module 25. The vital data module 25 cross checks other elements illustrated to determine whether a malfunction is occurring, and has an ability to safely cease operations of the system for remotely assisting operation of a railway vehicle system. The vital data module 25 has visual data and other sensor data with respect to data for safely operating the train 3. Such sensors 27 that may provide visual data and sensor data include, but are not limited to, optical sensors such as digital video camera, speed sensors, temperature sensors, oil pressure sensors, voltage sensors, current sensors, brake line pressure conveyed via end-of-train telemetry, operator input/output device status, and other locomotive sensors. Other sensors 27 that may provide data include signals mirroring single crew member, or on-board crew member, and controls and data input devices such as, but not limited to, the positive sign of life input of the on-board crew member, or on-board dead man protocol 60. The dead man protocol 60 is discussed below in further detail. Additional data that may be made available include, but are not limited to power notch setting, braking commands, and outputs of various engineer aids such as data produced by trip or rail network scheduling or optimizing systems. A few other types of sensors that may provide data also include, but are not limited to, microphones, an accelerometer, digital thermometers, and location detection sensors, such as an on-board GPS system.

A second module located on the locomotive 3 is an interface module 30. In an exemplary embodiment when a locomotive consist is provided, this module is located on the lead locomotive or where the on-board crew member 1 is located, but those skilled in the art will readily recognize that it may be located on any locomotive within the locomotive consist. The interface module 30 may be used by the on-board crew member 1 to request the presence ("on-boarding") of a virtual crew member, and allows the on-board crew member 1 to communicate directly with the virtual crew member 2. Personnel located at a remote monitoring station, dispatch or service center, or personnel on-board another train, may also request or direct the "on-boarding" of the virtual crew member to via the interface module or similar modules located at corresponding sites off-board the locomotive. The interface module 30 may include, but is not limited to, audio speakers to emit verbal communications and/or warning signals originating from the virtual crew member and/or a secondary device. A secondary device may include, but is not limited to, annunciators such as but not limited to alerts directed to the on-board crew member 1 to such conditions as upcoming crossings and track maintenance areas, speed limits, alarms (such as wheel slip, engine derations, temperature, etc.), grade crossings, track information, information from wayside equipments (such as hot box detectors, etc.), information from the dispatcher (such as meet/passes information, information about other trains, etc.), information regarding crew time out, taxi pick up, information about previous events, mile post, information from other crew, wayside crew, maintenance crew; meters, such as but not limited to air brake pressure, end of train information, train manifest information, etc; document facsimile receivers and printers to receive documents from the virtual second crew members 2, and visual displays to view either data originating from the virtual second crew member 2 and/or the virtual crew member, and lights for functions such as alerting the on-board crew member 1 to conditions noted at the remote locations but not yet acknowledged by the on-board crew member 1.

In another exemplary embodiment, the secondary device may function as a second crew member. More specifically, based on information provided by the secondary device a synthesized voice, and/or display of data, about the information may be provided to both the on-board crew member 1 and the virtual second crew member 2.

The interface module may also include a "quick response" or "quick action" interface that allows the on-board crew to submit a specific or immediate request for information or assistance. The "quick response" interface may include one or more keys or buttons associated with a pre-programmed request for a particular off-board expert. For example, the "quick response" interface could be used summon one or more virtual experts to assist the on-board crew member with the operation of the train. In accordance with one embodiment, the "quick response" interface could include buttons for virtually on-boarding a crew member by role, e.g., "Conductor," "Engineer," "Dispatch," etc. In accordance with another embodiment, the interface could include buttons for virtually on-boarding a crew member by technical expertise, e.g., "Engine," "Propulsion," "Electrical," "Brakes," etc. The "quick response" interface may be used to quickly "on-board" a specific virtual crew member from any number of remote sites, including but not limited to railroad, locomotive OEM, locomotive supplier or locomotive service provider sites.

A third module may be located on the locomotive consist 5 is a non-vital data module 26. The non-vital data module 26 performs periodic checks to improve the overall effectiveness of the system for providing a virtual crew member 2. If a malfunction is detected, the non-vital data module 26 can provide instructions to slow down the train 3 wherein the virtual crew member 2 may then perform cross checks of the elements in the system and inform the on-board operator 1 of the malfunction. One exemplary function of the non-vital data module 26 is to determine whether the dead man protocol 60 is functioning properly and if, based on pre-established boundaries, the effectiveness of the dead man protocol 60 is within acceptable parameters, this information may be transmitted to the virtual crew member 2. Functionally, a single module may perform the functions discussed above specific to the vital data module 25 and the non-vital data module 26. For example a single module may be available for determining and addressing malfunctions that are detected. In an exemplary embodiment, depending on specific operating rules of a railroad company and/or regulatory requirements, either the non-vital data module malfunction approach or the vital data module malfunction approach is used.

A fourth module 32 located on the locomotive is a control interface module 32. The control interface module 32 includes interfaces that facilitate necessary and appropriate control linkages between the locomotive 10 or the on-board crew member 1 and the virtual second crew member 2. Exemplary control linkages associated with the control interface module include, but are not limited to braking, power notch settings, warning horn activation, and emergency measures control activation.

Functionality of the modules 25, 30, 32 and transceiver 22 on the train 3 may be accomplished through a processor 35, or computer. The on-board crew member 1 also has access to display devices and operator interfaces. In an exemplary embodiment, the display device, operator interface, and processor are a computer 35 with a keyboard and monitor.

At the remote location 20, the virtual second crew member 2 may also receive data from wayside devices 40. Towards this end, the virtual second crew member 2 may provide verification of wayside train inspection system reports, such as providing a synthesized voice to the on-board crew member 1 when a hot bearing detector detects a hot bearing. Other wayside devices 40 that may provide direct feeds to the virtual second crew member 2 include, but are not limited to, hot wheel detectors, high/wide load detectors, track circuits and signals, crossing monitoring systems, and wayside cameras oriented at passing trains. Information obtained from these wayside devices 40 may be reviewed by the virtual second crew member 2 and vital data then communicated to the on-board crew member 1.

Based on the information available to the virtual second crew member 2, an alert can be initiated when the on-board crew and/or virtual second crew member needs to take action based on conditions and/or prior authorization from either crew member. The alert can be autonomous or initiated by the virtual second crew member. In another exemplary embodiment, the virtual second crew member 2 has the ability to control certain functions of the train 3. The level of control may include operating the function and/or limiting operations of the function. For example, but not limited to, the virtual second crew member may remotely command the train to brake, operate at a certain speed, prohibit the train to motor, etc. The control of a function may remain with the virtual second crew member 2 throughout the mission and/or the virtual second crew member may be able to impose control when a need arises.

The wayside equipment may directly communicate with the virtual second crew member 2. The virtual crew member 2 may possess more information than the operator 1 on-board the train 3 from dispatch information, other trains, wayside signals, and crossings, etc., which can be relayed to the on-board crew 1. The virtual crew member 2 may be able to consult with other virtual crew members due to proximity, and use of their expertise. Similarly the virtual crew member may also be able to use other data and/or expertise available off-board.

In another exemplary embodiment, actions taken during a trip may be stored, such as on a storage medium 45. The stored actions may then be played back wherein detailed views or information around a particular time of interest may be viewed. Such playbacks, in another exemplary embodiment may function as a remote black box, such as used on commercial airlines.

Figure 2:
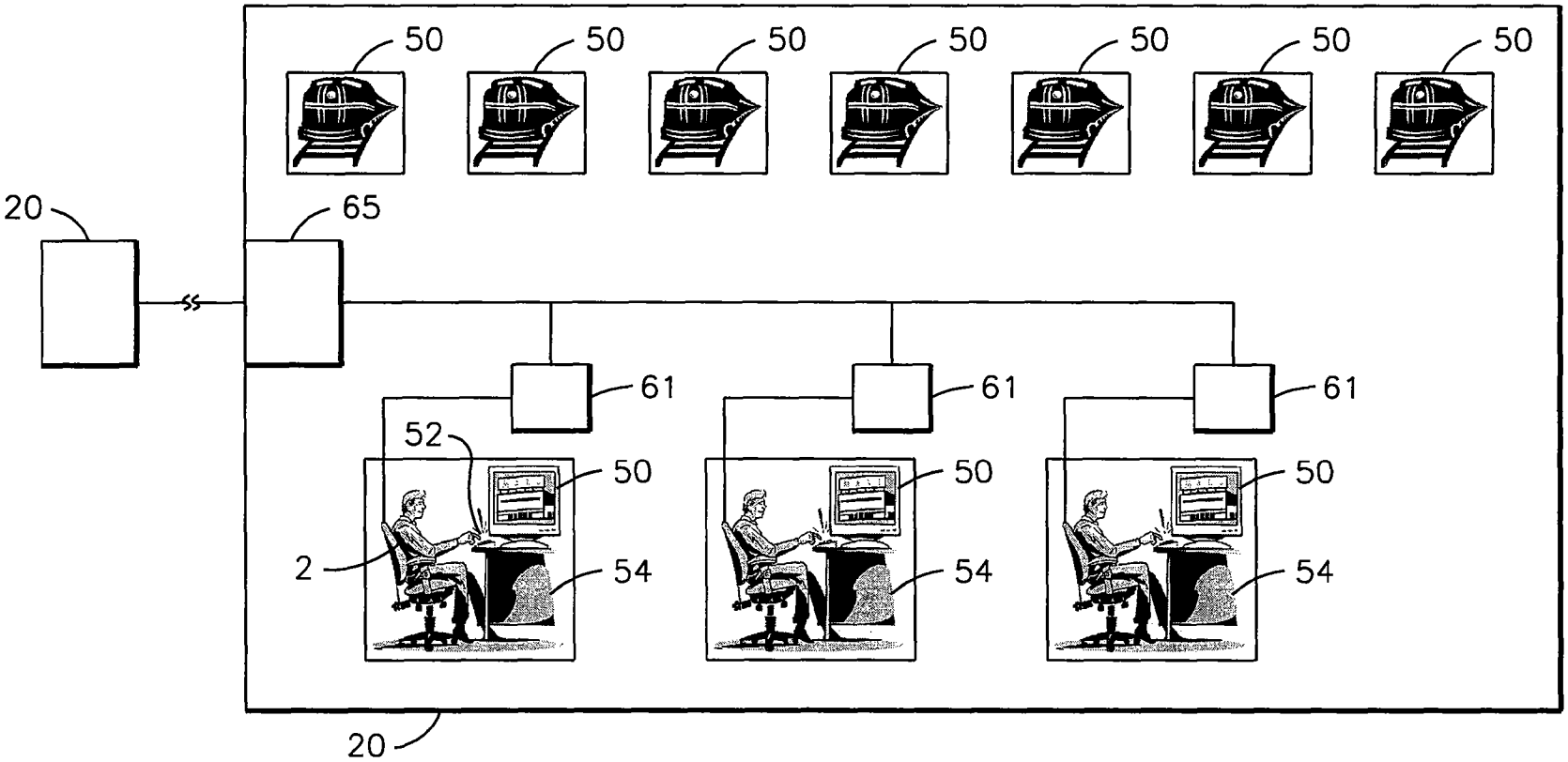
FIG. 2 depicts an exemplary embodiment of a remote location, such as a remote monitoring center.

FIG. 2 depicts an exemplary embodiment of a remote location, such as a remote monitoring center. At the remote location, display devices 50 and operator interfaces 52 are provided, allowing operators to function as virtual, second crew members. A processor 54, such as a computer is also provided. In an exemplary embodiment, the display device, operator interface, and processor are a computer 54 with a keyboard 52 and monitor 50. The number of operators may be less than the number of trains 3 served. The minimum ratio of operators to trains 3 served may be set so that the virtual second crew member 2 operation rises to a reasonable level of safety. The remote location 20 may be backed up by a failover protocol so that another remote location will take over the first remote location's functions should communications deteriorate to below a minimum acceptable level. There may also be an operational protocol executed on the train 3 outlining and specifying conditions and procedures should communications fail between the train 3 and any remote location 20.

Just as provided on the locomotive 10, a dead man handle, button, switch, or protocol, is also provided at the virtual second crew member. The dead man protocols 60 (illustrated in FIG. 1), 61 are provided to determine whether the virtual second crew member 2 and/or the on board crew member 1 are available. With respect to both dead man protocols 60, 61, notice is provided to the on-board crew member 1 and/or the virtual crew member 2 a minimum acceptable time interval to notify the entity at the other end that a person is still available at the other dead man protocol 60, 61 end. With respect to the dead man protocol 62 at the virtual second crew member 2, if the dead man protocol 62 does not detect the virtual second crew member 2, a failover protocol 65 allows for transfer of communication with the virtual second crew member 2 to another virtual crew member, either at the same remote location 20 or a second remote location 20. The dead man protocols 60, 61 may also be linked with the communication network 10, as illustrated in FIG. 1. Thus if the communication network 18 is unavailable for a predetermined minimum time interval, then the on-board crew member 1 is notified. Similarly, notification is also provided to the virtual crew member 2 if communication link loss, or outage, occurs so that the virtual crew member 2 may take responsive action.

In operations, if times arise when the virtual second crew member 2 is not available, a train 3 may still have a second on-board crew member aboard the train 3. However, since the assistance from this second on-board crew member may only be needed during brief communication interruptions or when the dead man protocol 61 does not detect a virtual second crew member 2, the skill sets for this second on-board crew member may be at a lower level than currently required of a second on-board crew member.

Though the remote location is disclosed as being a remote monitoring center, those skilled in the art will readily recognize that other locations may also function as the remote location. In an exemplary embodiment, the remote location may be another train, not shown. Towards this end, the first train 3 may have the above-discussed systems and individuals aboard to function as the virtual crew member 2 to other train 3 operating on a similar schedule as the first train 3. In another exemplary embodiment, the remote location is a location remote from the on-board crew member 1. Thus the remote location may be another location on the same locomotive that is remote from the location of the on-board crew member 1, within another locomotive within the same locomotive consist, and/or at another location within the same train 3. More specifically, with respect to the remote location being remote from the location of the on-board crew member 1, the intent is for the remote location to be at a remote location from where the operational controls for the train 3 are located.

Figure 3:
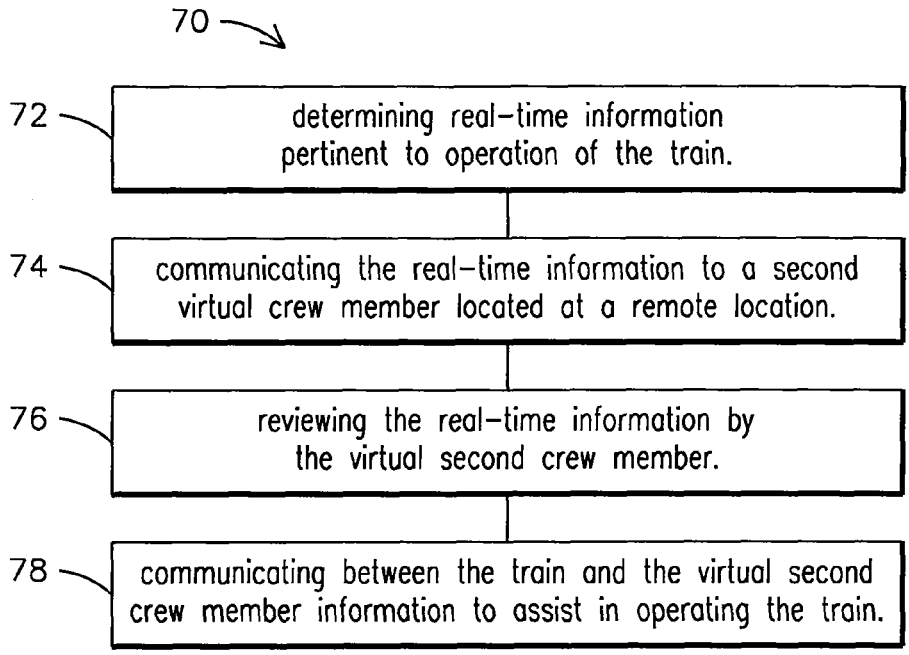
FIG. 3 depicts an exemplary embodiment of steps for allowing a single crew member to operate the train with a virtual second crew member located at a remote location.

FIG. 3 depicts an exemplary embodiment of steps for allowing a single crew member to operate a train with a virtual second crew member located at a remote location. The steps 70 include determining real-time information pertinent to operation of the train, step 72. The real-time information is communicated to a second virtual crew member located at a remote location, step 74. The real-time information is reviewed at the remote monitoring facility, step 76. The second virtual crew member communicates with the train 3 information that is required to operate the train, step 78. As discussed above, these steps 70 may be implemented with a computer implemented method, such as but not limited to a computer software code that has several computer software modules.

Another step that may be included is determining whether the second virtual crew member is available. Making a determination whether the single crew member is available is another step. Another step involves determining whether the step of communicating the real-time information and/or the step of communicating between the train and virtual second crew member is available. As mentioned above with respect to FIG. 3, these steps may be implemented as computer software modules that are part of the computer implemented method.

Figure 4:
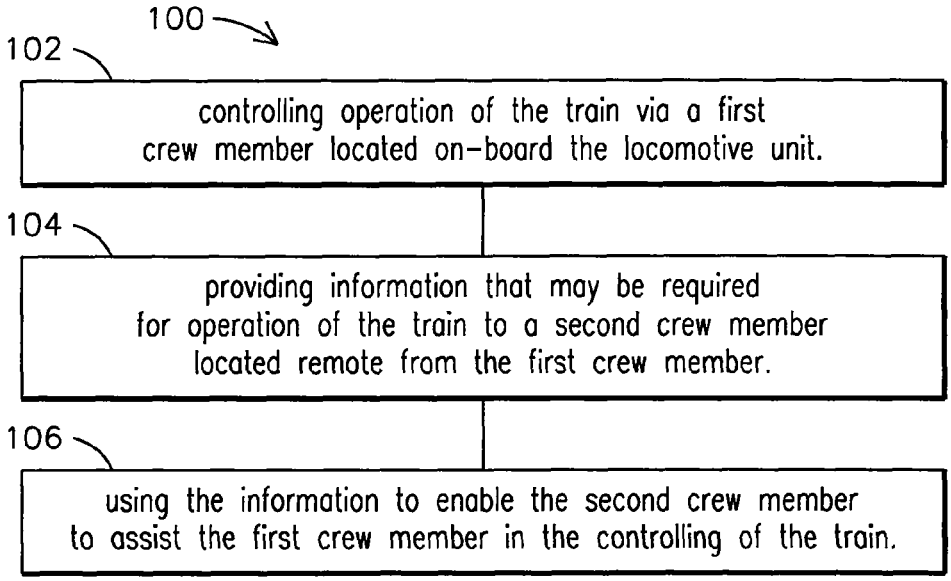
FIG. 4 depicts an exemplary embodiment of steps for operating a train having at least one locomotive.

FIG. 4 depicts an exemplary embodiment of steps for operating a train having at least one locomotive. The steps 100 include controlling operation of the train via a first crew member located on-board the locomotive, step 102. Information is provided that may be required for operation of the train to a second crew member located off-board the train, step 104. The information is used to enable the second crew member to assist the first crew member in controlling the train, step 106.

Another step that may be included is virtually on-boarding the second crew member by the first crew member. Yet another step may include virtually on-boarding the second crew member via personal at a remote location. Using an interface module on the locomotive to virtually on-board the second crew member is another available step. Also, using a "quick response" interface to virtually on-board the second crew member is also an available step. As discussed above with respect to FIG. 3, the steps disclosed in FIG. 4 and those mentioned above may be implemented with a computer implemented method, such as but not limited to a computer software code, that has several computer software modules.

While the invention has been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A system comprising:

an onboard processor configured to be disposed onboard a railway vehicle having onboard controls for operating the railway vehicle, the onboard controls being coupled to the onboard processor; and an interface configured to be disposed onboard the railway vehicle and coupled to the onboard processor, the interface connectable to a network for transferring data related to operation of the railway vehicle between the onboard processor and a first operator station at a first remote location;

wherein the interface is configured to receive a dead man signal from the first operator station, the dead man signal for providing a dead man alert if the first operator station at the first remote location is unattended for a predetermined period of time.

2. The system according to claim 1, wherein the onboard processor is configured to transfer the data to a second operator station upon receipt of the dead man signal from the first operator station.

3. The system according to claim 1, further comprising: one or more sensors configured to collect sensor data proximate the railway vehicle, the sensor data related to the operation of the railway vehicle, the one or more sensors configured to be in communication with the onboard processor for transferring the sensor data to the onboard processor.

4. The system according to claim 3, wherein at least one of the one or more sensors is configured to transmit the sensor data to a second processor located at the first operator station for permitting control of the railway vehicle from the first operator station.

5. The system according to claim 1, wherein the data related to the operation of the railway vehicle comprises at least one of real-time video data or real-time audio data.

6. The system comprising:

an onboard controller configured to be disposed on a railway vehicle having a plurality of operator controls disposed onboard the railway vehicle for controlling operation of the railway vehicle, the onboard controller for controlling one or more systems of the railway vehicle;

an interface module configured to be operatively coupled to the onboard controller and configured to communicate with a plurality of off board controllers located at a plurality of different remote locations through one or more communication networks, the interface module for transmitting data between the onboard controller and the one or more of the off board controllers;

wherein the railway vehicle is operable via one or more of the off board controllers; and, wherein the onboard controller is configured to initiate a request to at least one of the off board controllers seeking transfer of control of operation of the railway vehicle from the at least one of the off board controllers to the onboard controller, and wherein the interface module is configured to switch from transferring the data between the onboard processor and a first off board controller of the plurality of off board controllers to transferring the data between the onboard processor and a second off board controller of the plurality of off board controllers when communications between the interface module and the first off board controller fall below a designated level.

7. The system according to claim 6, wherein the data transmitted between the onboard controller and the one or more of the off board controllers comprises at least one of real-time video data or real-time audio data.

8. The system according to claim 1, wherein the interface is configured to receive input from an onboard operator disposed onboard the railway vehicle that selects one or more off board operators disposed at different remote locations disposed off board the railway vehicle to provide assistance with the operation of the railway vehicle.

9. The system according to claim 1, wherein the onboard processor is configured to receive wayside data acquired by one or more wayside devices from the first operator station, the wayside data being acquired by the first operator station and communicated to the onboard processor from the first operator station.

10. The system according to claim 1, wherein the interface is configured to switch from transferring the data related to the operation of the railway vehicle between the onboard processor and a second operator station at a different, second remote location when communications between the interface and the first operator station fall below a designated level.

11. The system according to claim 2, wherein the second operator station is at a different, second remote location than the first remote location.

12. The system according to claim 6, wherein the interface module is configured to receive input from an onboard operator disposed onboard the railway vehicle that selects one or more off board operators disposed at the different remote locations to provide assistance with the operation of the railway vehicle.

13. The system according to claim 6, wherein the onboard controller is configured to receive wayside data acquired by one or more wayside devices from at least one of the remote controllers, the wayside data being acquired by the at least one of the remote controllers and communicated to the onboard controller.

* * * * *